US007238039B2

(12) United States Patent
Holweg

(10) Patent No.: US 7,238,039 B2
(45) Date of Patent: Jul. 3, 2007

(54) PLUG-IN CONNECTOR COMPRISING A SECONDARY LOCKING MECHANISM IMPINGED BY A SPRING

(75) Inventor: Harald Holweg, Henfenfeld (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/526,593

(22) PCT Filed: Sep. 10, 2003

(86) PCT No.: PCT/EP03/10070

§ 371 (c)(1),
(2), (4) Date: Aug. 15, 2005

(87) PCT Pub. No.: WO2004/027938

PCT Pub. Date: Apr. 1, 2004

(65) Prior Publication Data

US 2006/0079118 A1 Apr. 13, 2006

(30) Foreign Application Priority Data

Sep. 11, 2002 (DE) ..... 102 42 074

(51) Int. Cl.
*H01R 13/627* (2006.01)
*H01R 3/00* (2006.01)

(52) U.S. Cl. ..... 439/352; 439/489

(58) Field of Classification Search ..... 439/350, 439/352, 353, 357, 507, 488, 489
See application file for complete search history.

(56) References Cited

U.S. PATENT DOCUMENTS

| | | | | |
|---|---|---|---|---|
| 5,080,611 | A | 1/1992 | Hypes | 439/567 |
| 5,938,470 | A | 8/1999 | Kashiyama | 439/489 |
| 5,975,914 | A | 11/1999 | Uchida | 439/66 |
| 6,287,139 | B1 | 9/2001 | Seko et al. | 439/489 |
| 6,699,059 | B2 * | 3/2004 | Nagamine et al. | 439/352 |
| 6,705,886 | B1 * | 3/2004 | Brown | 439/489 |
| 6,866,534 | B2 * | 3/2005 | Hirschmann | 439/352 |
| 2006/0079118 | A1 * | 4/2006 | Holweg | 439/489 |

FOREIGN PATENT DOCUMENTS

| | | |
|---|---|---|
| DE | 196 20 177 A1 | 11/1997 |
| DE | 198 47 872 A1 | 5/2000 |
| DE | 100 05 858 A1 | 8/2001 |
| DE | 100 35 726 A1 | 8/2001 |
| EP | 1 006 621 A2 | 6/2000 |
| EP | 1 006 621 A3 | 6/2000 |
| EP | 1 207 591 A3 | 5/2002 |

* cited by examiner

*Primary Examiner*—James R. Harvey
(74) *Attorney, Agent, or Firm*—Harrington & Smith, PC

(57) ABSTRACT

The invention relates to a plug-in connector (1), in particular for airbag retaining systems, comprising a first housing (2, 3), which can be locked into a mating connector (7) by means of locking arms (4*a*, 4*b*) and a secondary locking mechanism (5) that can be impinged by a spring force. Said secondary locking mechanism (5) has tongues (6*a*, 6*b*), which block the locking arms (4*a*, 4*b*) once the latter have engaged in the mating connector (7), in addition to detent arms (8*a*, 8*b*), which are blocked by the introduction of one edge (9) of the mating connector (7) until the locking arms (4*a*, 4*b*) are engaged and which then slide off the edge (9) as a result of the spring force that has accumulated up to this point, pressing the secondary locking mechanism (5) into its final position.

7 Claims, 7 Drawing Sheets

PLUG-IN CONNECTOR COMPRISING A SECONDARY LOCKING MECHANISM IMPINGED BY A SPRING

FIELD OF THE INVENTION

The present invention concerns a plug-in connector, in particular for airbag retaining systems according to the preamble of patent claim 1. Such a plug-in connector is known from DE 100 35,726 A1.

BACKGROUND OF THE INVENTION

In several respects, stringent requirements are placed on such plug-in connectors relative to the reliability of the connection that is produced and of the plugging-in process of a plug-in connector into its mating connector. In addition, the plug-in connection must be designed for a very long service life, during which fatigue phenomena of the seating of the plug must not occur.

A plug-in connector with a secondary locking mechanism is known from EP-1,207,591 A2, in which, during the plugging-in process of the connector into a corresponding mating connector and after the engaging of a primary locking mechanism, a secondary locking mechanism is moved into a slot between a tongue of the primary locking mechanism and the connector housing, in order to fill this slot and to prevent the primary locking mechanism from popping out of its locked position. In this case, the tongue of the secondary locking mechanism is continually under elastic strain in the final state, so that it may become subject to material fatigue, and, as the case may be, to material fracture over the long term. If pieces of the tongue of the secondary locking mechanism fall out of the slot, the secondary locking would therefore no longer be secure. At the very least, the correct seating of the plug-in connector in its mating connector would no longer be secure.

An electrical connector is known from DE 196 20,177 A1, in which an electrical contact between complementary connectors is first made toward the end of the plugging-in process in such a way that, during the plugging-in process, a spring is tensed, which moves the connectors into one another when a predetermined spring force has been exceeded and after release of its spring excursion.

DE 198 47,872 A1 describes an ignition bus housing with a secondary locking mechanism, which is pre-tensed by a spring during the plugging-in process and after engaging of the connector locking mechanism, moves by spring force over the connector lock and blocks it in its locking position.

In DE 100 05,858 A1, a spring clip acting as a safety device provides for the circumstance that the secondary locking can only take place when the connection of the connector has been concluded.

DE 100 35,726 A1 shows a contact support, in which a secondary locking mechanism is held back during the plugging-in process until the locking mechanism has been engaged. A spring tension is built up during the plugging-in process, and when this is released it moves the secondary locking mechanism into its final position. This release takes place after the spring tension has become large enough, due to the compression of the spring, in order to overcome an elastic resistance, which is formed by an elastic compressible clamp. The behavior of the latter determines the time point for triggering and this time can thus be determined only imprecisely and is hardly reproducible.

A plug-in connector with a secondary locking mechanism is known from EP 1,006,621 A1, wherein the secondary locking mechanism rests on one edge of the mating connector, until it is released by shifting laterally at a specific stage of the connecting process.

SUMMARY OF THE INVENTION

The object of the present invention is to further develop a plug-in connector of the type named initially in such a way that the secondary locking mechanism is supported by spring force at a pre-specified moment during the plugging-in process and is brought into its final position, but essentially rests free of mechanical strain in the final state.

This object is solved according to the claims.

The present invention is based on the concept of building up a spring force during the connecting process, by means of which the secondary locking mechanism is "catapulted" into its final position after the primary locking mechanism is engaged, and it then rests with essentially relaxed spring elements.

The spring elements can stand under slight mechanical strain in the final state, in order to prevent a chattering in the case of vibrations. The invention will be explained in more detail in the following, based on the description of an example of embodiment, which is not to be understood as limiting, with reference to the drawing.

BRIEF DESCRIPTION OF THE DRAWINGS

The following are shown therein.

DETAILED DESCRIPTION OF THE INVENTION

Figure 1:
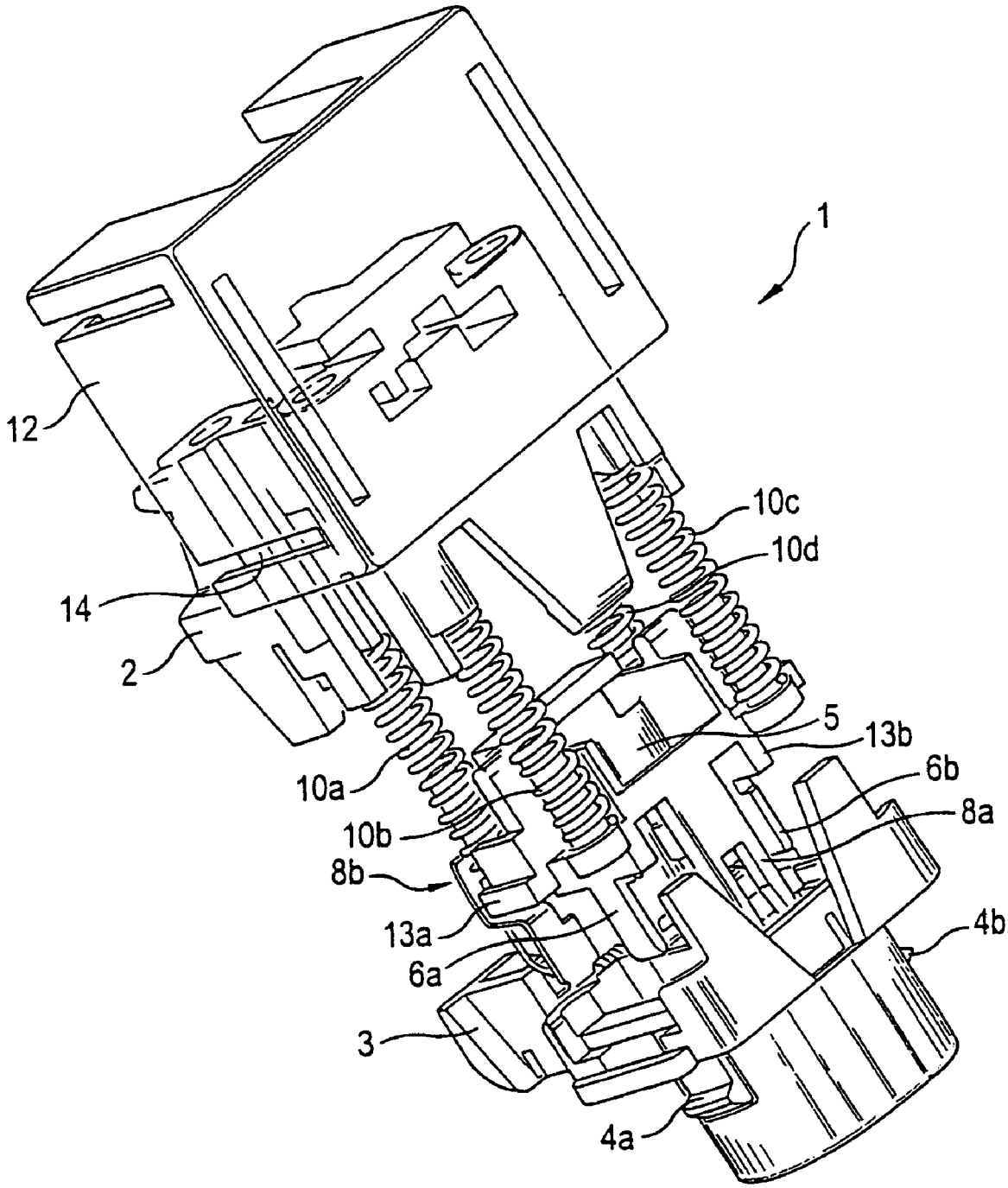
FIG. 1 an exploded view of the plug-in connector according to the invention, FIGS. 2 to 6 the individual steps of the plugging-in process, and FIG. 7 the unlocking of the plug-in connector from its mating connector.
Figure 3:
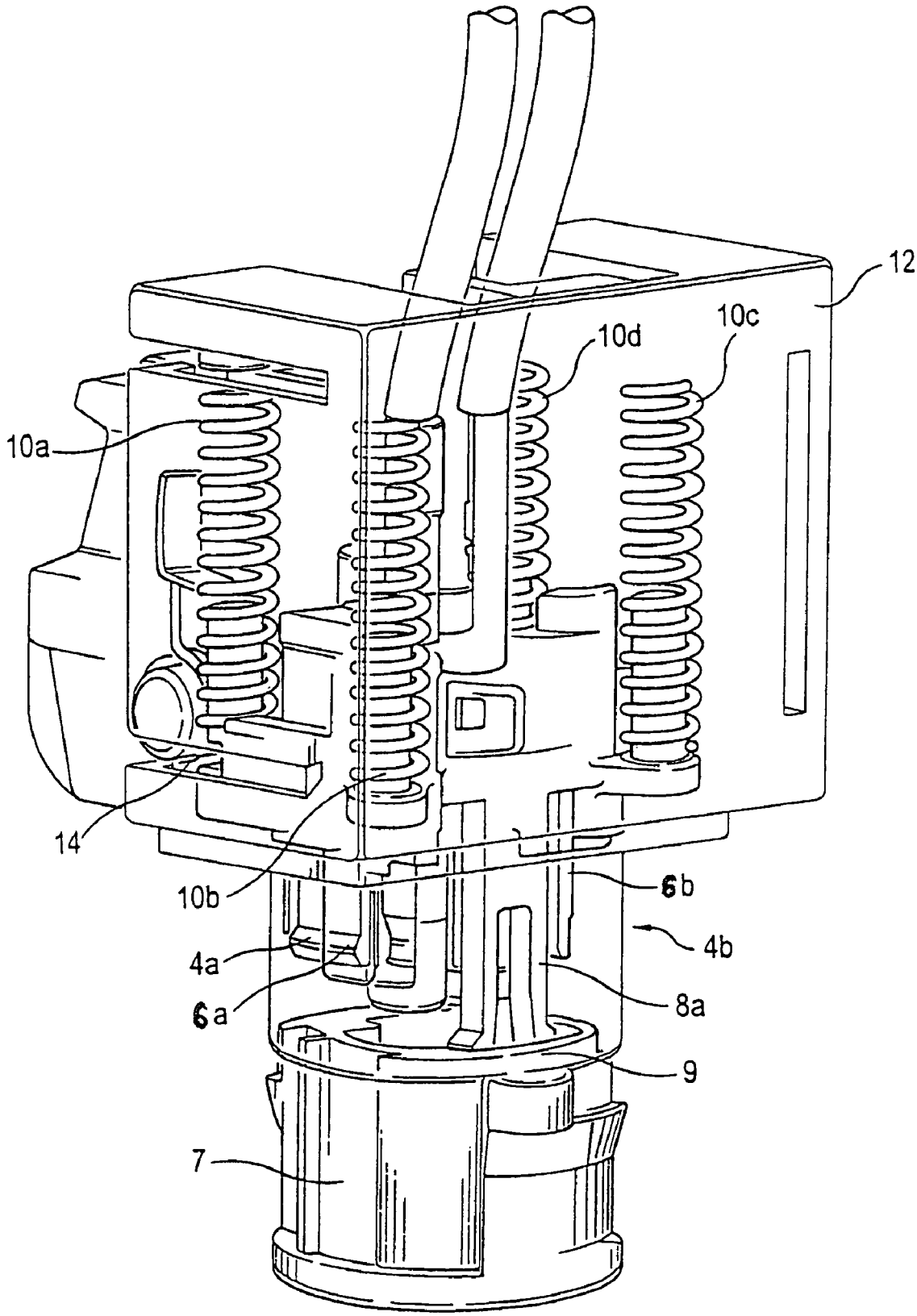

FIG. 1 shows an exploded view in perspective of the plug-in connector 1 according to the invention. The housing is designed of two parts and is comprised of a housing part 3 on the connector side and a housing part 2 on the side turned away from the connector, and these parts are locked with each other. The housing part 3 on the connector side has locking arms 4*a*, 4*b*, with which the plug-in connector 1 is locked in a mating connector 7 (FIG. 3). Within housing 2, 3, a secondary locking mechanism 5 is found, which has tongues 6*a*, 6*b*, which, after locking of the locking arms 4*a*, 4*b* in the mating connector 7, fill a gap between the body of the plug-in connector and the locking arms 4*a*, 4*b* and thus prevent a swinging back of the locking arms 4*a*, 4*b* out of their locking position.

Further, the secondary locking mechanism 5 has detent arms 8*a*, 8*b* (FIG. 2), which will be explained in more detail in the following, and are formed like a tuning fork in the example of embodiment which is shown, with beveled free ends 11*a*, 11*b*, on which are found catch pieces pointing outward. At the beginning of the plugging-in process of the plug-in connector, the secondary locking mechanism is supported by these free ends 11*a*, 11*b* in its mating connector 7, supported at the edge 9 of an opening in the mating connector. The secondary locking mechanism 5 is attached by means of four spiral-shaped pressure springs at the back housing part 2 seen in the direction of plugging in, in the example of embodiment shown. The pressure springs are aligned coaxially to the direction of plugging in. In the state as supplied, i.e., the two housing parts 2, 3 are locked with one another, the pressure springs 10*a* to 10*d* are either almost not compressed at all or are only very slightly compressed. A slight compression serves to protect the connector from chattering.

The back housing part 2 has on opposite-lying sides, longitudinal slots 14 perpendicular to the direction of plugging, into which pieces 13*a*, 13*b*, which are formed on the secondary locking mechanism 5, project. A detaching aid 12 is plugged onto these pieces 13*a*, 13*b* by means of slot 14 in its side walls, and this aid surrounds the housing 2, 3 at least partially. This detaching aid can be moved by an operator in the direction opposite the plugging-in direction against the action of the force of the pressure springs 10*a* to 10*d*, whereby the locking tongues 6*a*, 6*b* and the detent arms 8*a*, 8*b* can be pulled out of the mating connector and the plug connection can be detached.

The individual steps of the plugging-in process will be explained in the following on the basis of FIGS. 2 to 6.

Figure 2:
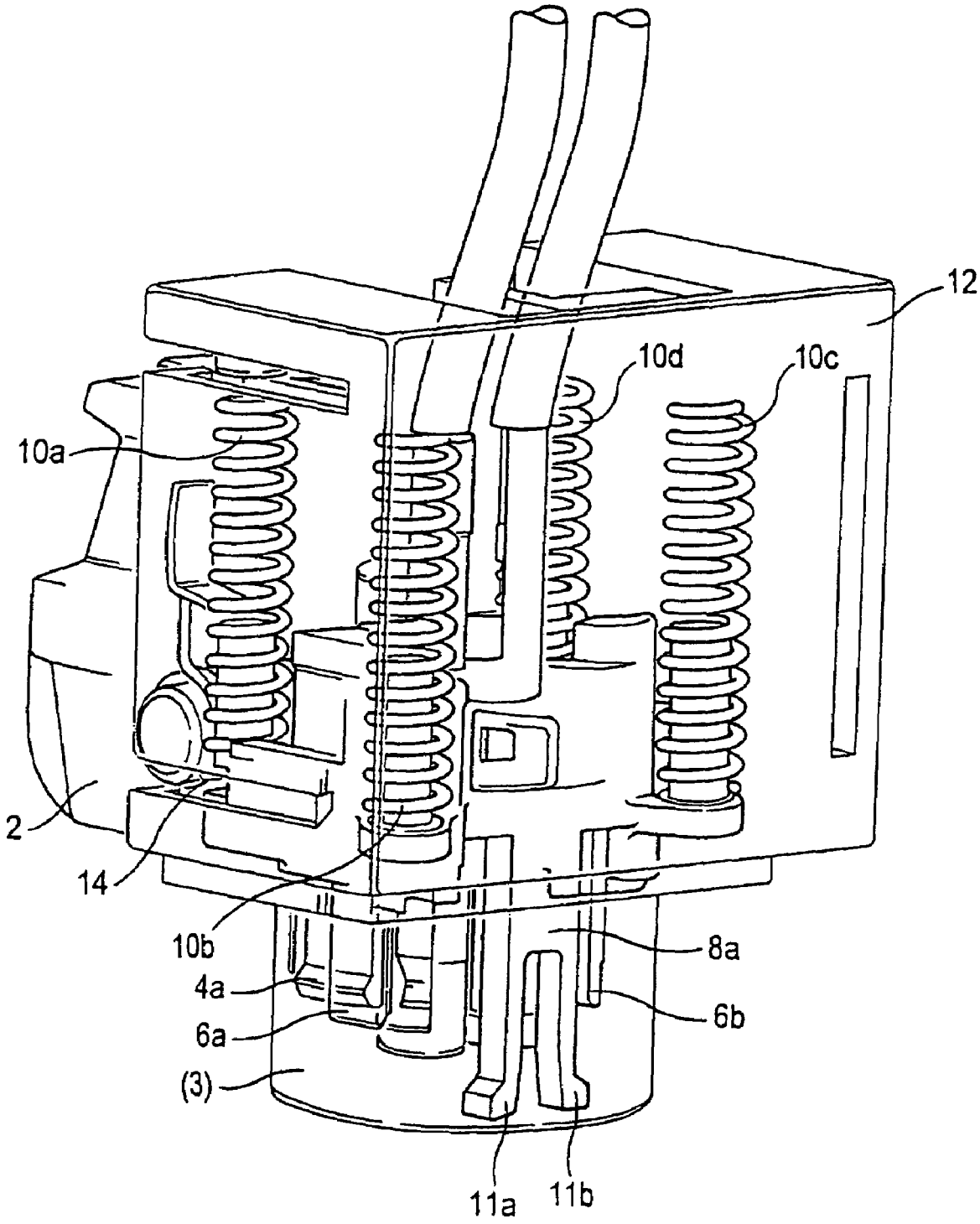

FIG. 2 shows the as-supplied state of the plug-in connector, in which, as has already been explained above, the pressure springs 10*a* to 10*d* are essentially relieved of strain and the free ends 11*a*, 11*b* of the detent arms 8*a*, 8*b* are arranged protected in the connector part of housing part 3.

FIG. 3 shows the plug-in connector 1 at the moment in which it is mated with mating connector 7, i.e., it is put directly in contact with the latter. The free ends 11*a*,11*b* of the detent arms 8*a*, 8*b* in this case lie on the front surface of mating connector 7. In other respects, FIG. 3 does not differ from FIG. 2.

Figure 4:
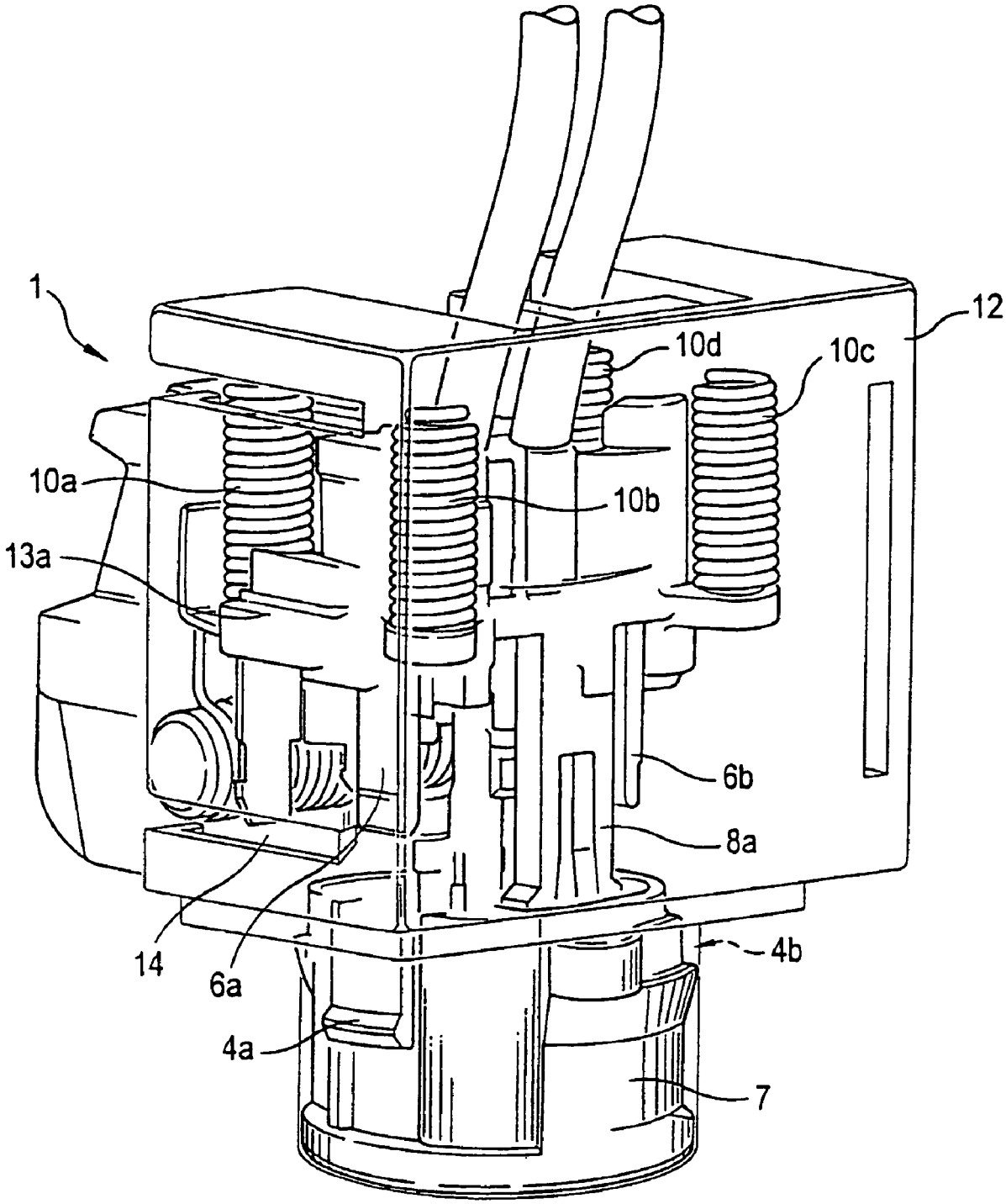

The final position of plug-in connector 1 in mating connector 7 is shown in FIG. 4, i.e., the locking arms 4*a*, 4*b* are engaged behind shoulders, which are not shown here, of mating connector 7. The plugging-in process has been produced against the spring force of pressure springs 10*a* to 10*d*, which are now all almost completely compressed. In this state, the detent arms 8*a*, 8*b* are still continually supported at the edges 9 of the mentioned opening in the mating connector 7. This state changes abruptly, right after the detent arms 4*a*, 4*b* are snapped in.

Figure 5:
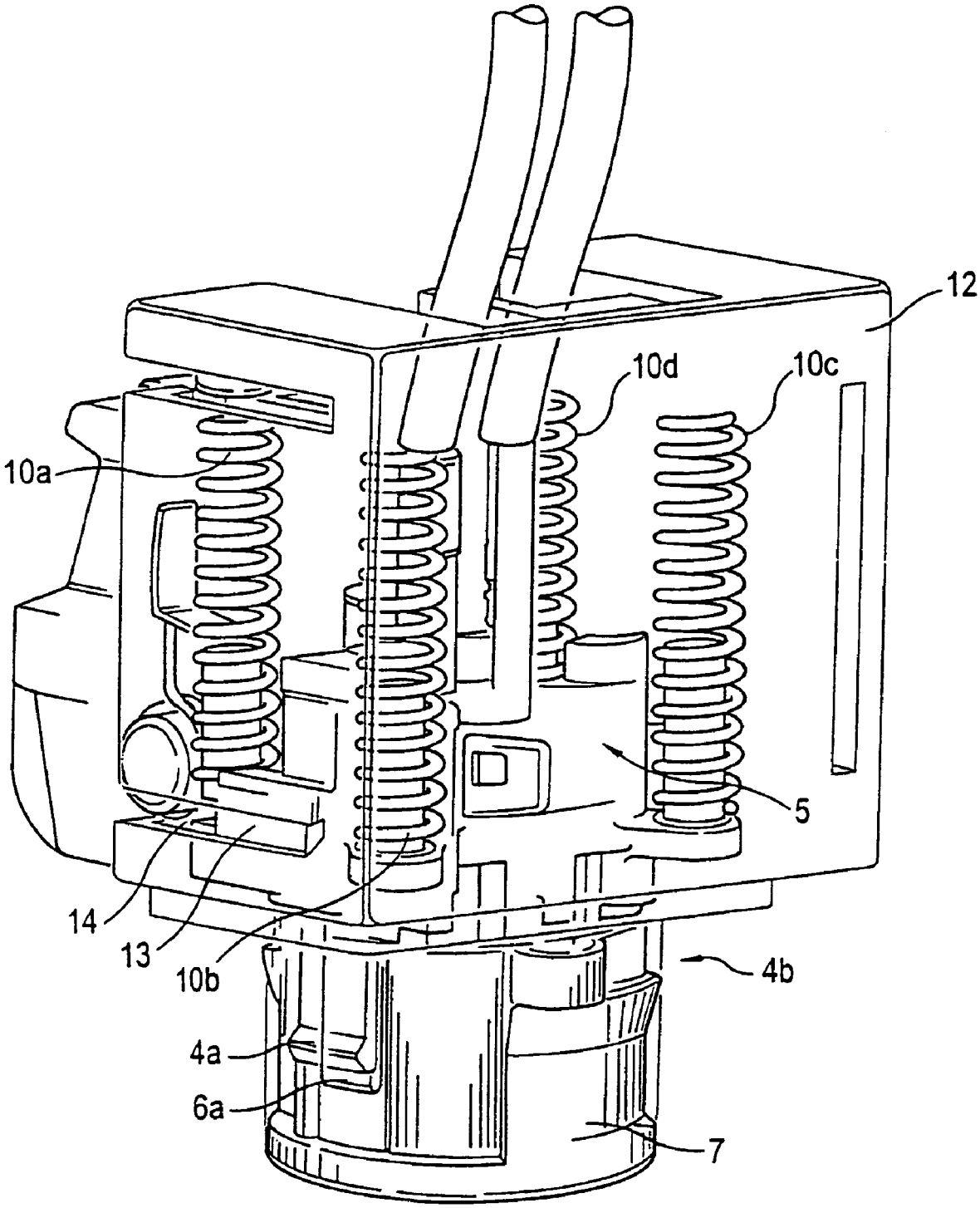

FIG. 5 shows this state, i.e., a slight pressure loading in the plugging-in direction of the plug-in connector 1 leads to the condition that the detent arms 8*a*, 8*b* are slipped out, pressed away from the edges 9 of the opening in the mating connector 7, by ramps disposed on housing part 3 and the detent arms 8*a*, 8*b* are catapulted into the slot by the force of pressure springs 10*a* to 10*d*, so that the secondary locking mechanism 5 snaps into its final position, whereby the tongues 6*a*, 6*b* are introduced into the opening behind the detent arms 4*a*, 4*b*.

Figure 6:
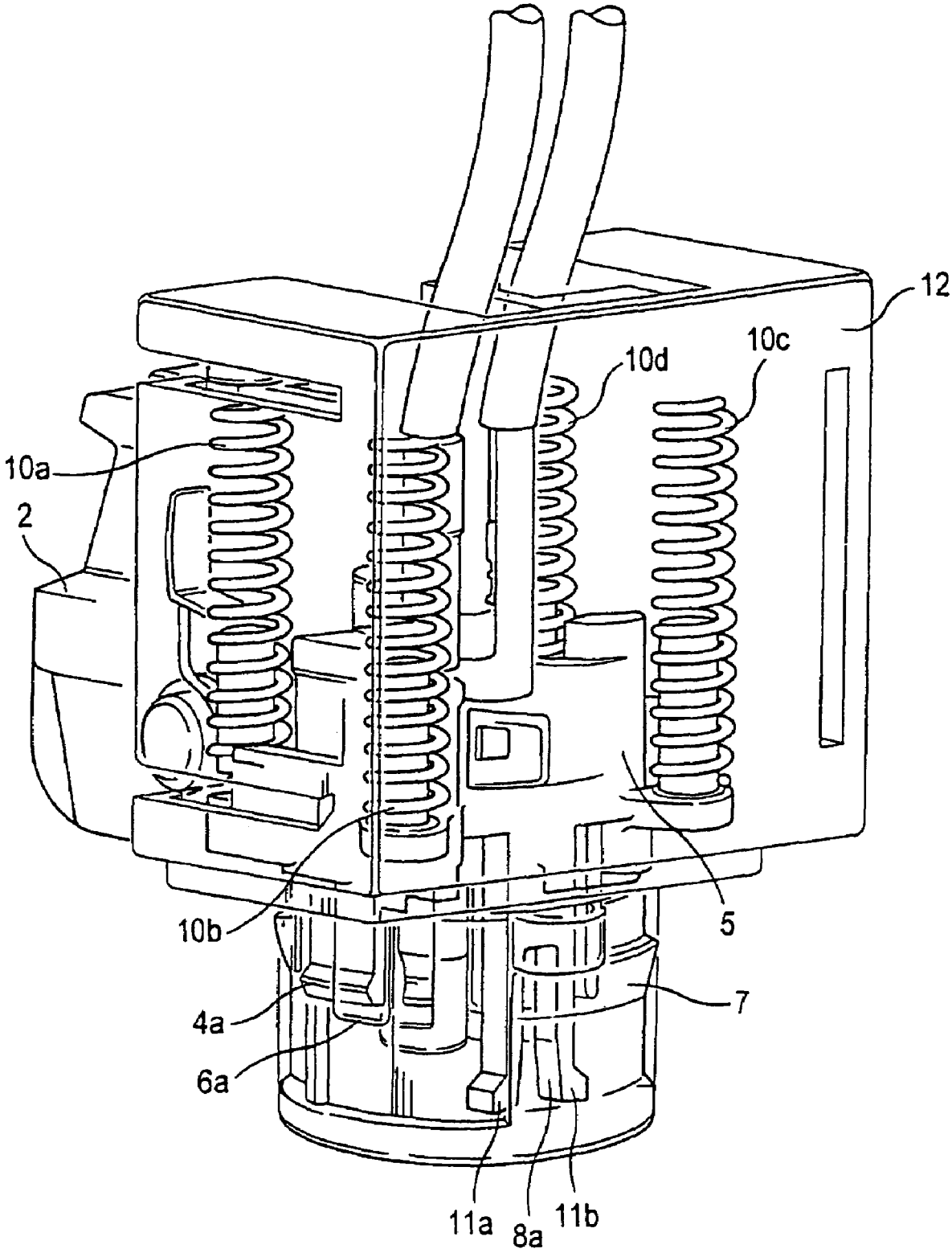

FIG. 6 shows this state once more, wherein, however, the free ends 11*a*, 11*b*, which are spread apart from one another, of detent arms 8*a*, 8*b* are shown, with which the secondary locking mechanism 5 has been locked in mating connector 7.

Figure 7:
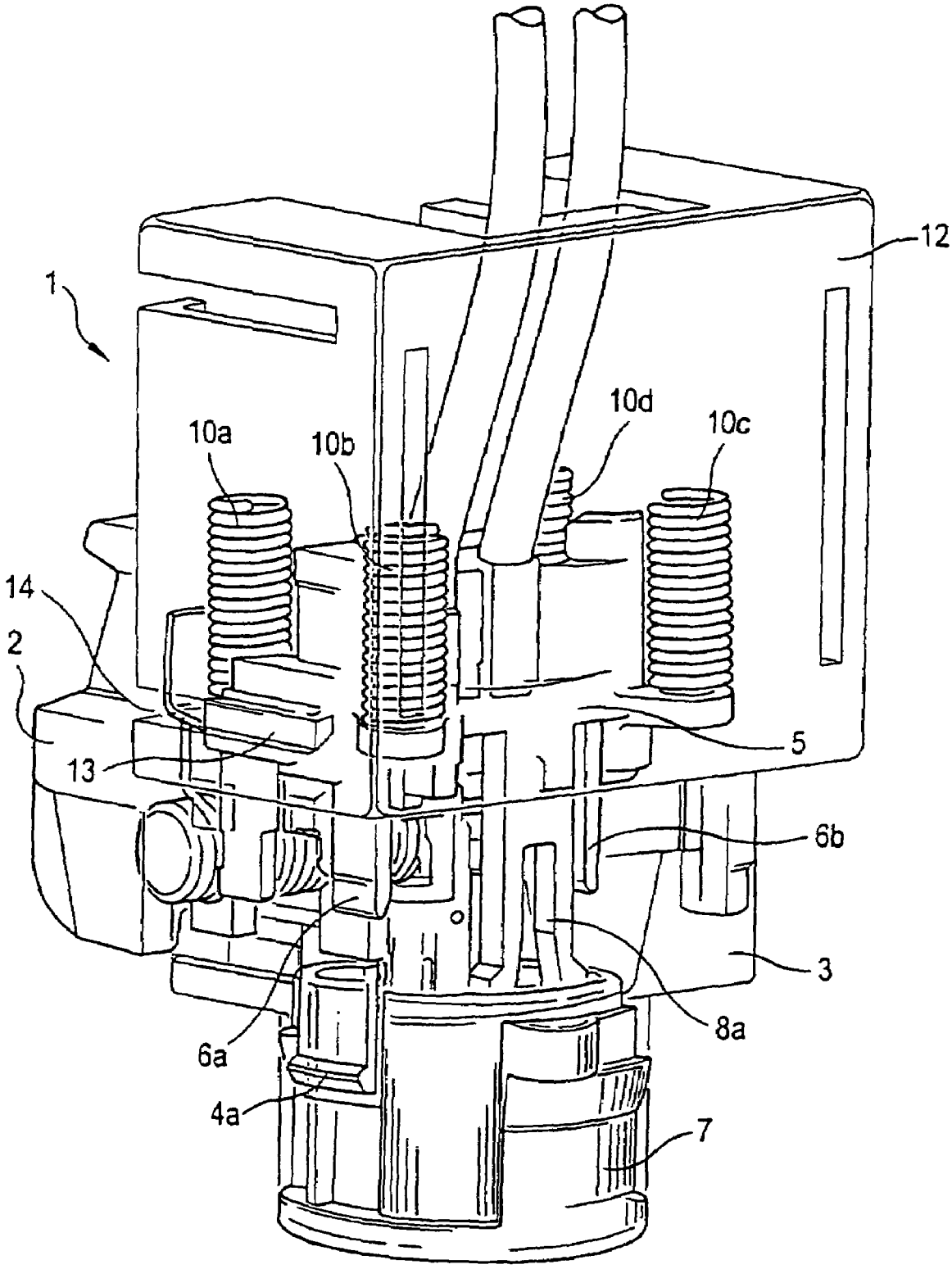

FIG. 7 shows the unlocking process, wherein the detaching aid 12 is pulled in the direction opposite the plugging-in direction, against the action of the pressure springs 10*a* to 10*d*. In this way, the secondary locking mechanism 5 is detached from mating connector 7, so that the secondary locking of locking arms 4*a*, 4*b* is abolished and an additional pull on detaching aid 12 pulls the plug-in connector 1 out of the mating connector 7.

The plug connection produced in this way allows only unequivocal states which are also clearly perceived by the user. The "shooting in" of the secondary locking mechanism is clearly perceptible and ends up in a clearly locked state due to the pressure loading. Therefore, the plug-in connector according to the invention assures an increased security, which is particularly essential for use as an airbag connector.

The invention claimed is:

1. A plug-in connector, in particular for airbag retaining systems comprising a first housing, which can be locked in a mating connector by means of locking arms, and a secondary locking mechanism that can be loaded with a spring force, in which the secondary locking mechanism has tongues, which block the locking arms after they are engaged in the mating connector, as well as detent arms, which are blocked by one edge of the mating connector during the introduction process, until the locking arms are engaged, wherein the detent arms are then adapted to slide off the edge, wherein due to the spring force that has been previously built up, the secondary locking mechanism is then adapted to be moved into its final position, wherein the detent arms have beveled catch pieces on their free ends.

2. A plug-in connector, in particular for airbag retaining systems comprising a first housing, which can be locked in a mating connector by means of locking arms, and a secondary locking mechanism that can be loaded with a spring force, in which the secondary locking mechanism has tongues, which block the locking arms after they are engaged in the mating connector, as well as detent arms, which are blocked by one edge of the mating connector during the introduction process, until the locking arms are engaged, wherein the detent arms are then adapted to slide off the edge, wherein due to the spring force that has been previously built up, the secondary locking mechanism is adapted to be moved into its final position, wherein ramps on a part of the first housing move the detent arms away from edge.

3. The plug-in connector according to claim 1, further characterized in that the secondary locking mechanism is supported on housing by means of at least one helical spring, wherein the helical spring or springs is or are relieved of strain when the plug-in connector is not plugged in as well as when it is plugged in.

4. The plug-in connector according to claim 3, further characterized in that the detent arms are shaped like a pair of tuning forks with catch pieces protruding outward.

5. The plug-in connector according to claim 2, further characterized in that the housing has a connecting half and a back half, which can be locked with one another and in which the secondary locking mechanism with helical springs is disposed.

6. A plug-in connector, in particular for airbag retaining systems comprising:

a first housing, which can be locked in a mating connector by means of locking arms, and a secondary locking mechanism that can be loaded with a spring force, in which the secondary locking mechanism has tongues, which block the locking arms after they are engaged in the mating connector, as well as detent arms, which are blocked by one edge of the mating connector during the introduction process, until the locking arms are engaged, wherein the detent arms are then adapted to slide off the edge, wherein due to the spring force that has been previously built up, the secondary locking mechanism is adapted to be moved into its final position, wherein the detent arms have beveled catch pieces on their free ends, further characterized in that the secondary locking mechanism has pieces running crosswise to the plugging-in direction on opposite-lying sides, and these pieces engage in corresponding slots of a detaching aid surrounding the housing at least partially, and the secondary locking mechanism can be pulled out of mating connector by this aid against the force of springs and then the housing can be detached from mating connector in the state where the secondary lock is no longer engaged.

7. A plug-in connector comprising a first housing having locking arms, wherein the first housing is adapted to be locked in a mating connector by the locking arms, and a secondary locking mechanism connected to the first housing, wherein the secondary locking mechanism is adapted to be loaded with a spring force on the first housing, wherein the secondary locking mechanism has tongues and detent arms, wherein the tongues are adapted to block the locking arms after the locking arms are engaged in the mating connector, wherein the detent arms are adapted to be blocked by an edge of the mating connector during insertion of the first housing into the mating connector until the locking arms are engaged with the mating connector, wherein the detent arms have beveled free ends and/or a part of the first housing have ramps which are adapted to engage the detent arms such that, after the locking arms are engaged in the mating connector and after a build up of the spring force, the detent arms are adapted to be moved away from edge to move the secondary locking mechanism into its final position.

* * * * *